US005592140A

United States Patent [19]

Tokunaga et al.

[11] Patent Number: 5,592,140

[45] Date of Patent: Jan. 7, 1997

[54] VARISTOR FORMED OF BISMUTH AND ANTIMONY AND METHOD OF MANUFACTURING SAME

[75] Inventors: Hideaki Tokunaga, Shijyonawate; Yasuo Wakahata, Katano; Naoki Mutoh, Chitose, all of Japan

[73] Assignee: Matsushita Electric Industrial Co., Ltd., Osaka, Japan

[21] Appl. No.: 313,598

[22] Filed: Sep. 29, 1994

[30] Foreign Application Priority Data

Sep. 29, 1993 [JP] Japan ..... 5-242428

[51] Int. Cl.[6] ..... H01C 7/10

[52] U.S. Cl. ..... 338/21

[58] Field of Search ..... 338/20, 21

[56] References Cited

U.S. PATENT DOCUMENTS

| | | | |
|---|---|---|---|
| 5,075,666 | 12/1991 | Radford | 338/21 |
| 5,369,390 | 11/1994 | Lin et al. | 338/21 |

FOREIGN PATENT DOCUMENTS

| | | |
|---|---|---|
| 2373497 | 7/1978 | France . |
| 2-184552 | 7/1990 | Japan . |
| 2-309603 | 12/1990 | Japan . |
| 3-211705 | 9/1991 | Japan . |
| 5-234716 | 9/1993 | Japan . |
| 5-226116 | 9/1993 | Japan . |

*Primary Examiner*—Geoffrey S. Evans
*Assistant Examiner*—Raphael Valencia
*Attorney, Agent, or Firm*—McDermott, Will & Emery

[57] ABSTRACT

The varistor element contains zinc-oxide as a main constituent and at least bismuth and antimony as accessory constituents. The content of bismuth in the form of $Bi_2O_3$ is in a range from about 0.1 to 4.0 mol % and the content of antimony in the form of $Sb_2O_3$ constitutes a mol-ratio of $Sb_2O_3/Bi_2O_3$ less than or equal to about 1.0 mol %. These materials are mixed thoroughly and are pressed into a compact. After coating both sides of the compact with Ag or Ag—Pd paste, the compact and its electrodes are sintered simultaneously at a temperature of about 800° C. to 960° C.

17 Claims, 5 Drawing Sheets

VARISTOR FORMED OF BISMUTH AND ANTIMONY AND METHOD OF MANUFACTURING SAME

FIELD OF THE INVENTION

This invention relates to a varistor developed to protect electronic devices such as television receivers when abnormally high surge voltage is applied thereon, and its manufacturing method.

BACKGROUND OF THE INVENTION

Since modern electronic devices such as television receivers have an increased number of functions, circuits of more complicated and higher integration have to be incorporated therein. In addition, these complicated circuits have to be protected against possible surge voltage by means of an electronic device such as varistor made of zinc-oxide. Therefore, the demand for varistors of this type is rapidly increasing.

A conventional zinc-oxide varistor can be manufactured by mixing zinc oxide with nickel, cobalt, and antimony compounds. These materials are molded into a compact which is then sintered at a temperature of 1150° C. to 1350° C. This sintered compact is then coated with electrode paste made of platinum or palladium and baked to form two electrodes thereon.

However, when antimony is added to the materials as an accessory constituent, the compact can not be sintered thoroughly at the above-mentioned temperature. Inability to thoroughly sinter the compact has been a primary problem of the conventional type of varistor.

SUMMARY OF THE INVENTION

The objective of the present invention is to solve this problem, and to offer a varistor composition which can be 5sintered at a relatively low temperature of about 800° C. to 1000° C. despite antimony added as an accessory constituent. Furthermore, another object of the invention is to provide a manufacturing method thereof.

According to the invention, a sintered varistor compact has a pair of electrodes provided on the both sides of said compact. The main constituent of the varistor compact is zinc-oxide, and bismuth and antimony are added thereto as accessory constituents. Where the total of the main and accessory constituents is set at 100 mol %, the bismuth content in the form of $Bi_2O_3$ is about 0.1–4.0 mol %, and the antimony content is set to obtain a mol-ratio of ($Sb_2O_3$/$Bi_2O_3$) less than or equal to about 1.0.

Moreover, as an accessory constituent, boron in the form of $B_2O_3$ can be contained in the varistor of the invention at an amount of $B_2O_3$ less than or equal to about 0.5 mol %.

Furthermore, as additional accessory constituents, at least more than one element among lead, germanium, or tin in the form of PbO, $GeO_2$, or $SnO_2$can be contained in the varistor of the invention at an amount of (PbO+$GeO_2$+$SnO_2$) less than or equal to about 0.5 mol %.

Moreover, as additional accessory constituents, at least one or more elements among lead, germanium, or tin in the form of PbO, $GeO_2$, or $SnO_2$ can be contained in the varistor of the invention at an amount of (PbO+$GeO_2$+$SnO_2$) less than or equal to about 0.15 mol %.

As still another accessory constituent, aluminum in the form of $Al_2O_3$ can be contained in the varistor of the invention at an amount of about 0.001–0.01 mol %.

As yet another accessory constituent, bismuth in the form of $Bi_2O_3$ can be contained at an amount of about 0.1–4.0 mol %, and as additional accessory constituents, at least one element among antimony or phosphor in the form of $Sb_2O_3$ or $P_2O_5$ can be contained in the varistor of the invention at an amount of ($Sb_2O_3$+$P_2O_5$) less than or equal to about 1.0 mol %. However, in this case, the content of $P_2O_5$ should not be more than about 0.3 mol % and the mol-ratio ($Sb_2O_3$+$P_2O_5$)/$Bi_2O_3$ should not be more than 1.0.

Furthermore, the varistor of the invention can be manufactured by thoroughly mixing zinc oxide employed as a main constituent with bismuth and antimony employed as accessory constituents, pressing the mixture into a compact, coating the compact with an electrode paste, using a simultaneous sintering of said compact and electrodes at a temperature of about 800° C. to 960° C. In this manufacturing process of the invented varistor, Ag paste or Ag—Pd paste can be used as an electrode paste.

As other accessory constituents, bismuth in the form of $Bi_2O_3$ can be added at an amount of about 0.1–4.0 mol %, and antimony in the form of $Sb_2O_3$ can be added at an amount to constitute a mol-ratio of ($Sb_2O_3$/$Bi_2O_3$) less than or equal to about 1.0 mol % during the manufacturing process of the invented varistor.

As another accessory constituent, boron in the form of $B_2O_3$ can be added during the manufacturing process of the varistor of this invention in an amount of $B_2O_3$ less than or equal to about 0.5 mol %.

As additional accessory constituents, at least one or more of the elements lead, germanium, or tin in the form of PbO, $GeO_2$, or $SnO_2$can be added during the manufacturing process of the varistor of this invention in an amount of (PbO+$GeO_2$+$SnO_2$) less than or equal to about 0.15 mol %.

In another variation, the varistor of this invention can be manufactured by thoroughly mixing zinc oxide employed as a main constituent with bismuth employed as an accessory constituent in the form of $Bi_2O_3$ at an amount of about 0.1–4.0 mol % and at least one of antimony or phosphor in the form of $Sb_2O_3$ or $P_2O_5$ in an amount to constitute a mol-ratio of ($Sb_2O_3$+$P_2O_5$) less than or equal to about 1.0 mol % (however, the content of $P_2O_5$ should not be more than about 0.3 mol %, and the mol-ratio of ($Sb_2O_3$+$P_2O_5$)/$Bi_2O_3$ should not be more than 1.0). This mixture is pressed into a compact and coated with a conductive electrode paste. compact and electrodes are simultaneously sintered at a temperature of about 800° C. to 960° C.

Furthermore, the varistor of this invention can be manufactured by thoroughly mixing zinc oxide employed as a main constituent with bismuth and antimony employed as accessory constituents, pressing this mixture into a form of a ceramic sheet, laminating a plurality of said ceramic sheets each provided with internal electrode layers connecting each of these internal electrodes alternatively exposing each ends of said internal electrode layers at two ends of said laminate, forming a pair of external electrodes at both ends of said laminate, and sintering said laminate and said internal electrode layers simultaneously at a temperature of about 800° C.–960° C.

The pair of external electrode of the laminated varistor of this invention can be formed by applying a Ag paste or Ag—Pd paste. Additionally, said internal electrodes of the laminated varistor of this invention can be manufactured by applying a Ag paste or Ag—Pd paste.

Bismuth in the form of $Bi_2O_3$ can be added at an amount of about0.1–4.0 mol %, and antimony in the form of $Sb_2O_3$ can be added at an amount to constitute a mol-ratio of ($Sb_2O_3/Bi_2O_3$) less than or equal to about 1.0 mol % during the manufacturing process of the laminated varistor of this invention. As an additional accessory constituent, boron in the form of $B_2O_3$ can be added during the manufacturing process of the laminated varistor of this invention in an amount of $B_2O_3$ less than or equal to about 0.5 mol %.

Moreover, as additional accessory constituents, one or more of the elements lead, germanium, or tin in the form of PbO, $GeO_2$, or $SnO_2$ can be added during the manufacturing process of the laminated varistor of this invention in an amount of ($PbO+GeO_2+SnO_2$) less than or equal to about 0.5 mol %.

Furthermore, the varistor of this invention can be manufactured by mixing zinc oxide employed as a main constituent with bismuth in the form of $Bi_2O_3$ added at an amount of about 0.1–4.0 mol % and at least one of antimony or phosphor in the form of $Sb_2O_3$ and $P_2O_5$ at an amount to constitute a mol ratio of ($Sb_2O_3+P_2O_5$) less than or equal to about 1.0 mol % employed as accessory constituents, (however, in this case, the content of $P_2O_5$ should not be more than about 0.3 tool %, and the mol ratio of ($Sb_2O_3+P_2O_5$)/$Bi_2O_3$ should not be more than 1.0), pressing this mixture into a form of ceramic sheet, surface coating this sheet with internal electrode layers, laminating plural of said sheets into a laminate consisting of plural numbers of said ceramic sheets and said internal electrode layers laminated alternatively and the each ends of said internal electrode layers exposing each ends of said internal electrode layers alternatively, forming a pair of external electrodes at both ends of said laminate, and sintering said laminate and said internal electrode layers simultaneously at a temperature of about 800° C.–960° C.

As pointed out in greater detail below, employing the varistor construction of this invention provides important advantages. The varistor can be sintered at a temperature substantially lower than that of conventional varistor, and thus, the varistor compact and the electrodes can be sintered simultaneously, eliminating an extra electrode sintering process and improving the varistor productivity.

Thus, because of its lower sintering temperature, energy for heating can be saved, and because the compact and electrodes have the same shrinkage coefficients at sintering, adhesion between the compact and electrode can be higher and thus higher reliability can be obtained. Furthermore, by introducing phosphor and boron as accessory constituents, various varistor characteristics including anti-surge and high-temperature load-life characteristics can be improved substantially.

The invention itself, together with further objects and attendant advantages will be best understood by reference to the following detailed description taken in conjunction with the accompanying drawings.

DESCRIPTION OF THE PREFERRED EMBODIMENT

Figure 1:
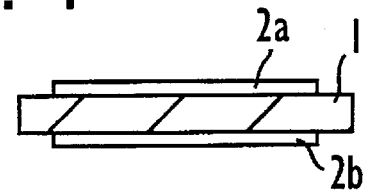
FIG. 1 shows a cross-sectional view of an embodiment of a varistor in accordance with this invention.

A preferred embodiment of the invention is explained below with reference to FIG. 1.

Initially, ceramic materials including ZnO as main constituent and $Bi_2O_3$ at about 1.0–4.0 mol %, $CO_2O_3$ at about 0.5 mol %, $MnO_2$ at about 0.15 mol %, $Sb_2O_3$ at about 0–4.5 mol %, and $Al_2O_3$ at about 0.005 mol % as accessory constituents, are mixed thoroughly after an organic binder is added. By applying a pressure of 1 ton/cm$^2$, this mixture is pressed into a disk-shaped compact having a diameter of 10 mm and a thickness of 1.2 mm. After applying an electrode paste consisting of silver powder and an organic binder, the compact is sintered at a temperature of about 750° C.–960° C., and a varistor element 1 and the electrodes 2*a* and 2*b* are formed.

Figure 2:
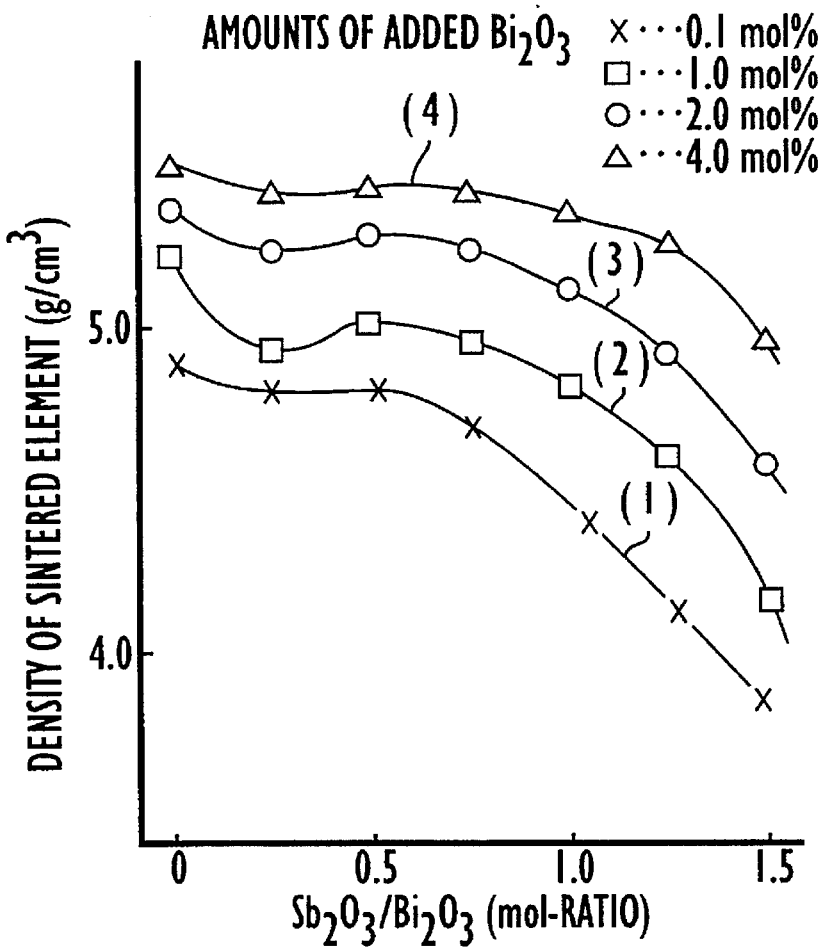
FIG. 2 shows characteristics of a varistor which is an embodiment of this invention, showing a relationship between the density of the sintered varistor element and the mol-ratio of ($Sb_2O_3/Bi_2O_3$) thereof.

A relationship between the density and the mol-ratio of $Sb_2O_3/Bi_2O_3$ of the varistor element 1 sintered at 900° C. is shown in FIG. 2, wherein the degree of sintering is expressed in terms of densities of the varistor element 1. Line (1) in FIG. 2 shows a relationship between the density and the mol-ratio of the varistor element 1 containing $Bi_2O_3$ at 0.1 mol %. Lines (2), (3) and (4) show the relationship between the density and the mol-ratio of the varistor element 1 containing $Bi_2O_3$ at 1.0 mol %, 2.0 mol %, and 4.0 mol %, respectively.

As shown in FIG. 2, the densities show an initial decrease when the amount of added $Sb_2O_3$ is increased. However, the density increases when $Sb_2O_3/Bi_2O_3$ equals 0.5. This is then followed by a gradual decrease as the amount of $Sb_2O_3$ added to the varistor element 1 is increased.

Figure 3:
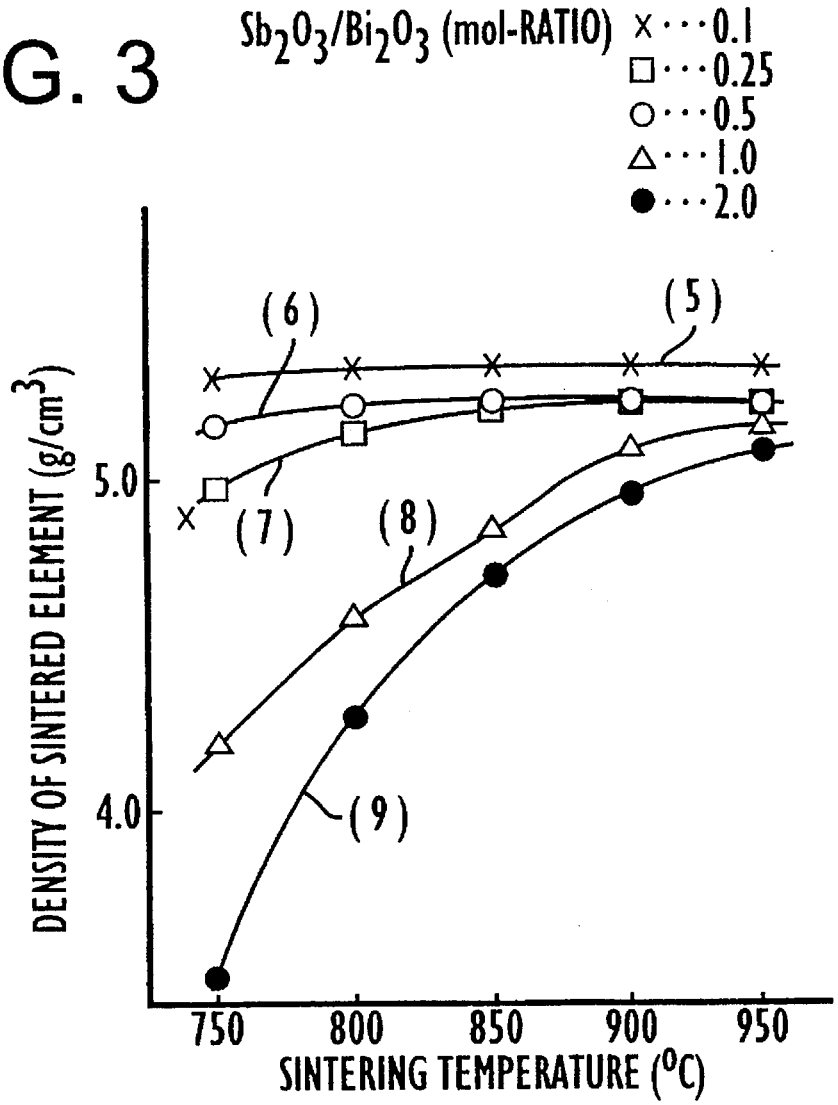
FIG. 3 shows characteristics of a varistor which is an embodiment of this invention, showing a relationship between the sintering temperature and the density of the sintered varistor element.

A relationship between the sintering temperature and the density of the varistor element 1 changing the mol-ratio of ($Sb_2O_3/Bi_2O_3$) is shown in FIG. 3 where the amount of added $Bi_2O_3$ is 1.0 mol %. Line (5) in FIG. 3 shows densities of a varistor containing $Bi_2O_3$ at a mol % of 0.1, Line (6) at a mol % of 0.25, Line (7) at a mol% of 0.5, Line (8) at a mol % of 1.0, and Line (9) at a mol % of 2.0, sintered at the respective temperatures.

As shown in FIG. 3, the densities of the varistor element 1 are constant beyond 750° C. when the mol-ratio of ($Sb_2O_3/Bi_2O_3$) equals 0.5. This constant density proves that the sintering is adequately performed. However, the changes in varistor density are large when the mol-ratio of ($Sb_2O_3$/$Bi_2O_3$) is brought up to a value of 1.0 or 2.0, showing inadequate sintering performed at 850° C.

Figure 4:
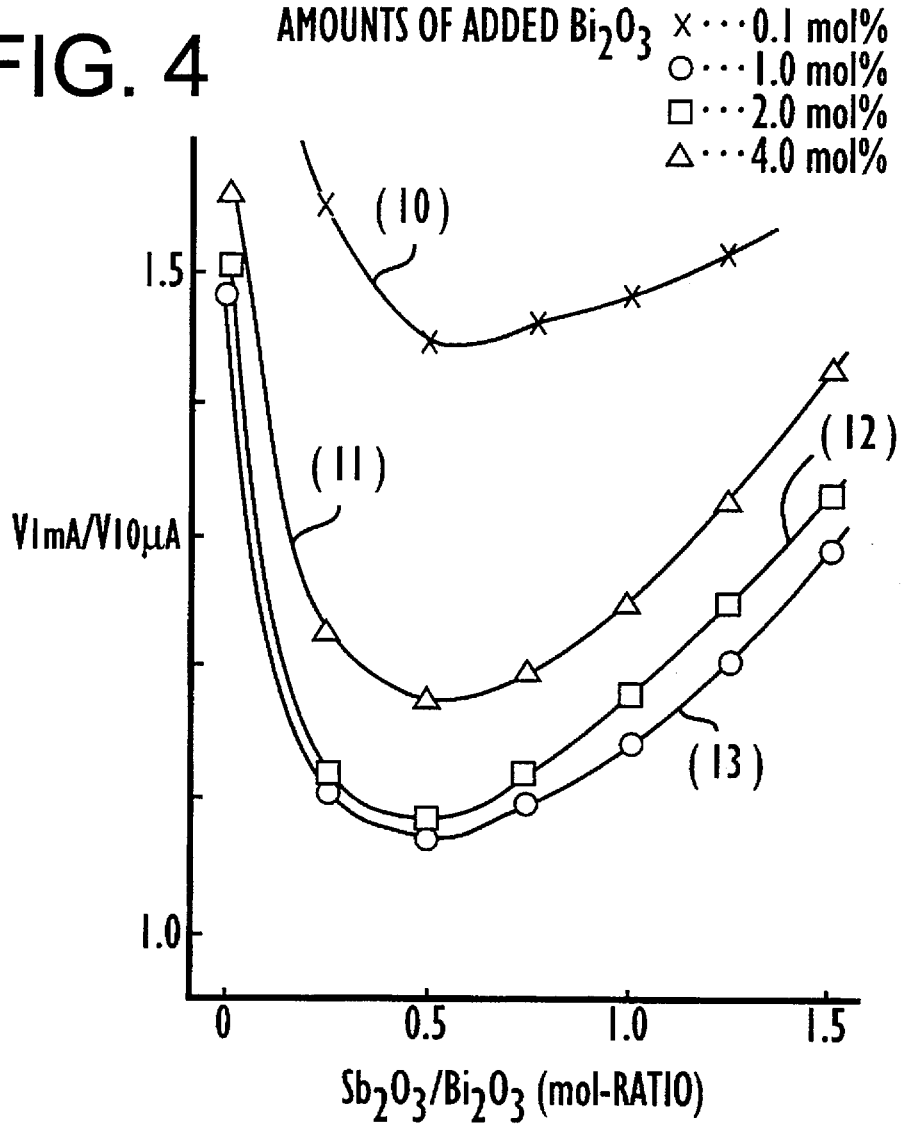
FIG. 4 shows characteristics of a varistor which is an embodiment of this invention, showing a relationship between the characteristic value of the varistor ($V_{1\ mA}/V_{10\ \mu A}$) and the mol-ratio of ($Sb_2O_3/Bi_2O_3$) thereof.
Figure 5:
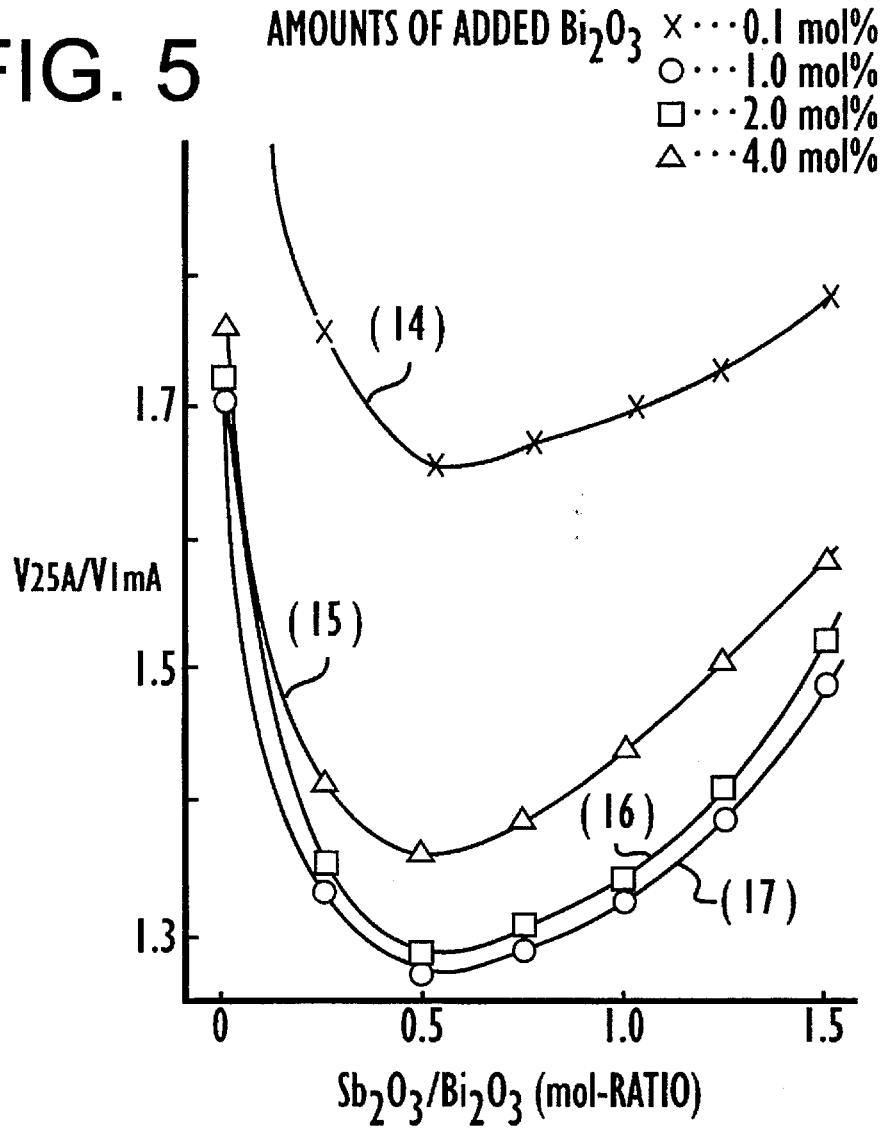
FIG. 5 shows characteristics of a varistor which is an embodiment of this invention, showing a relationship between the characteristic value of the varistor ($V_{25A}/V_{1\ mA}$) and the mol-ratio of ($Sb_2O_3/Bi_2O_3$) thereof.

FIGS. 4 and 5 show relationships between the mol-ratio of ($Sb_2O_3/Bi_2O_3$) and the characteristics of the varistor element sintered at a temperature of 900° C. The voltage-ratio shown in FIG. 4 is an index of nonlinearity, showing the ratios of voltages obtained at a current ratio of 10 μA/1 mA, that is, ($V_{1\ mA}/V_{10\ \mu A}$) respectively.

The limiting voltage-ratio shown in FIG. 5 is an index of varistor characteristics in the high-voltage range, showing the voltage ratios between the voltage ($V_{25\ A}$) obtained at a surge current of 25A, and the voltage ($V_{1\ mA}$) obtained at a current of 1 mA.

In FIG. 4, Lines (10), (11), (12), and (13) show the voltage ratios obtained when $Bi_2O_3$ is 0.1 mol %, 1.0 mol %, 2.0 mol %, and 4.0mol %, respectively. In FIG. 5, Lines (14), (15), (16), and (17) are obtained when $Bi_2O_3$ is 0.1 mol %, 1.0 mol %, 2.0 mol%, and 4.0 mol %, respectively. As shown in FIGS. 4 and 5, both the optimum voltage ratios and the limiting voltage ratios are obtained when ($Sb_2O_3/Bi_2O_3$) equals 0.5.

From the above descriptions, when ($Sb_2O_3/Bi_2O_3$) is less than or equal to about 1.0 (mol ratio), the sintering is accomplished within a temperature range of about 750° C.–960° C., and the varistor density shows a maximum at a mol ratio of ($Sb_2O_3/Bi_2O_3$) equal 0.5 despite the added antimony. This means that the optimum sintering characteristics, together with the optimum voltage-ratio and the limiting voltage ratio characteristics are obtained when ($Sb_2O_3/Bi_2O_3$) is less than or equal to about 1.0 mol ratio and sintering is done at a temperature of about 750° C.–960° C.

Another variation of the invention is explained below with reference to Table 1. Ceramic materials including ZnO as a main constituent, and $Bi_2O_3$ added in an amount of about 1.0 mol %, $Co_2O_3$ at about 0.5 mol %, $MnO_2$ at about 0.15 mol %, $Sb_2O_3$ at about 0–1.0 mol %, $Al_2O_3$ at about 0.005 mol %, and $P_2O_5$ at about 0–1.0 mol % as accessory constituents, are thoroughly mixed. Varistors of this embodiment are prepared by applying the same method as the one shown in the preferred embodiment wherein the sintering temperature is 900° C.

Table 1 shows the relationship between the characteristics of the varistor element 1 in which $Sb_2O_3$ is added at 0.5 mol % and the amount of added $P_2O_5$. The surge current waveform takes a form of 8×20 μs.

TABLE 1

| $P_2O_5$ (mol %) | Density (g/cm$^3$) | $V_{1mA}/V_{10\mu A}$ | Max surge current (Amp) |
|---|---|---|---|
| 0 | 5.25 | 1.10 | 1000 |
| 0.05 | 5.28 | 1.09 | 1500 |
| 0.1 | 5.30 | 1.08 | 2000 |
| 0.3 | 5.30 | 1.15 | 2000 |
| 0.5 | 5.39 | 1.23 | 2000 |
| 1.0 | 5.39 | 1.50 | 1500 |

As shown in Table 1, the density of the varistor element 1 is substantially increased and the maximum surge current is improved by adding $P_2O_5$, while the voltage-ratio characteristics is sacrificed by the addition of $P_2O_5$ beyond a certain point. Therefore, the maximum surge current characteristics can be improved without affecting the other varistor characteristics by adding $P_2O_5$ in an amount in a range of $P_2O_5$ is less than or equal to about 0.3 (mol %).

Figure 6:
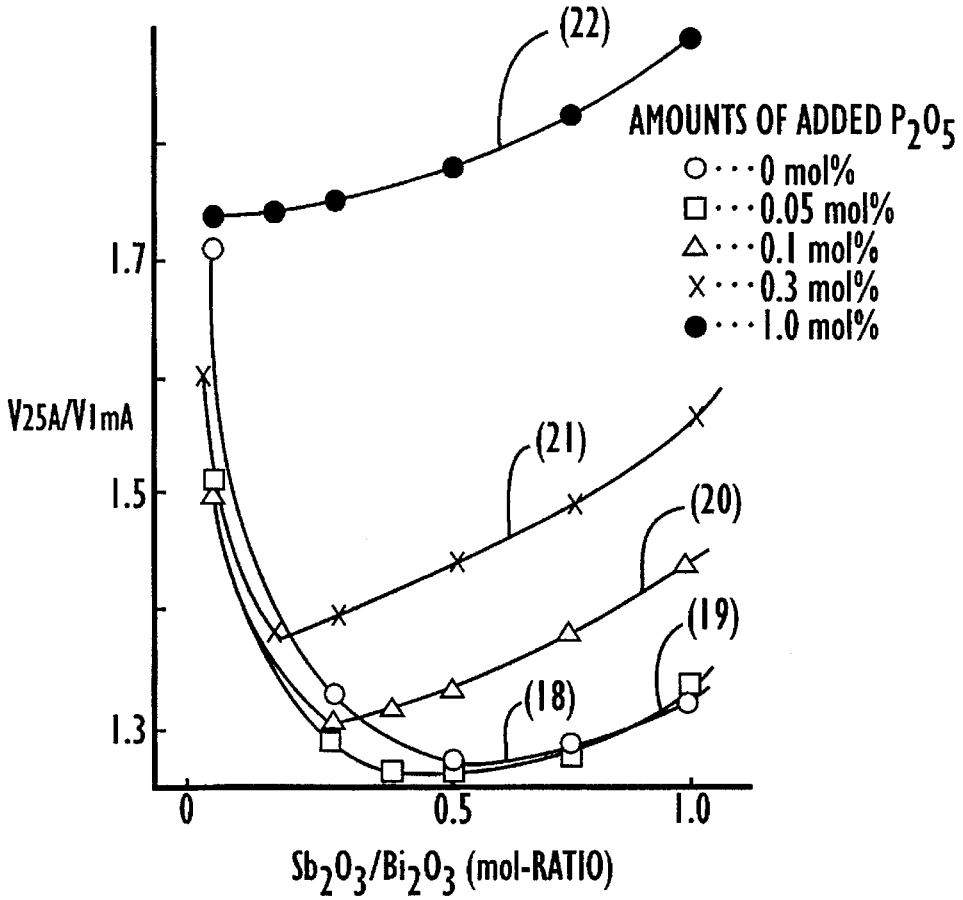
FIG. 6 shows characteristics of a varistor containing phosphor which is an embodiment of this invention, showing a relationship between the characteristics value of varistor ($V_{25\ A}/V_{1\ mA}$) and the mol-ratio of ($Sb_2O_3/Bi_2O_3$) thereof.

The relationships between the mol-ratios of ($Sb_2O_3/Bi_2O_3$) and the limiting voltage ratios ($V_{25\ A}/V_{1\ mA}$) when the added amount of $P_2O_5$ is changed to 0, 0.05, 0.1, 0.3, and 1.0 (mol %) are shown in FIG. 6, wherein Lines (18), (19), (20), (21), and (22) show a limiting voltage ratio characteristics obtained when $P_2O_5$ is added at an amount of 0 mol %, 0.05 mol %, 0.1 mol %, 0.3 mol %, and 1.0 mol %, respectively. As shown in FIG. 6, the optimum limiting voltage-ratio is shifted toward the smaller value of $Sb_2O_3/Bi_2O_3$ as the amount of added $P_2O_5$ is increased.

From these facts and because antimony and phosphor belong to a same family, it is understandable that the effects of phosphor and antimony are the same to an extent. Thus, the sintering characteristics of the varistor element 1 and the maximum surge current characteristics can be are substantially improved by replacing antimony with phosphor.

In yet another variation of the invention, ceramic materials including ZnO as a main constituent, and $Bi_2O_3$ added at an amount of about 1.0 mol %, $Co_2O_3$ at about 0.5 mol %, $MnO_2$ at about 0.15 mol %, $Sb_2O_3$ at about 0–0.5 mol %, $Al_2O_3$ at about 0.005 mol %, and $B_2O_3$ at about 0–1.0 mol % as accessory constituents, are thoroughly mixed, and the varistors shown in Table 2 are prepared using the same method shown in the preferred embodiment wherein the sintering temperature is 900° C.

Table 2 shows a relationship between the varistor characteristics and the amount of added $B_2O_3$.

TABLE 2

| $B_2O_3$ (mol %) | Density (g/cm$^3$) | *Change in $V_{1mA}$ (%) (in P – dir.) | $V_{25A}/V_{1mA}$ |
|---|---|---|---|
| 0 | 5.25 | 20 | 1.33 |
| 0.01 | 5.26 | 10 | 1.33 |
| 0.05 | 5.27 | 3 | 1.34 |
| 0.1 | 5.30 | 2 | 1.35 |
| 0.5 | 5.35 | 5 | 1.36 |
| 1.0 | 5.37 | 5 | 1.38 |

*is a high-temperature load-life characteristics expressed in terms of variation of $V_{1mA}$.

The change of $V_1$mA, or the high-temperature load-life characteristics shown in Table 2, are changes of varistor voltage ($V_1$mA) in percent evaluated after a voltage causing a varistor current of 1 mA is applied for 100 hours at 125° C. As shown in Table 2, a substantial improvement of high-temperature load-life characteristics is obtained by increasing the amount of added $B_2O_3$ due possibly to an improvement of sintering characteristics. Increasing the amount of $B_2O_3$ is similar to adding glass-frit to a conventional varistor. Specifically, increasing the amount of $B_2O_3$ decreases the need for glass-frit. However, the limiting voltage ratio is decreased as the amount of added $B_2O_3$ is increased.

In yet another variation of the invention, ceramic materials including ZnO as a main constituent, and $Bi_2O_3$ added at an amount of about 1.0 mol %, $CO_2O_3$ at about 0.5 mol %, $MnO_2$ at about 0.15 mol %, $Sb_2O_3$ at about 0.5 mol %, PbO at about 0–0.1 mol %, $GeO_2$ at about 0–0.1 mol %, and $SnO_2$ at about 0–0.1 mol %, and $Al_2O_3$ at about 0.005 mol % as accessory constituents, are thoroughly mixed, and the mixture is sintered at a temperature of 900° C. by applying the same method shown in the preferred embodiment. Using this mixture, varistors having maximum surge current characteristics shown in Table 3 are prepared.

TABLE 3

| $GeO_2$ mol % $SnO_2$ | PbO . . . 0 mol % | | | $GeO_2$ mol % $SnO_2$ | PbO . . . 0.05 mol % | | | $GeO_2$ mol % $SnO_2$ | PbO . . . 0.1 mol% | | |
|---|---|---|---|---|---|---|---|---|---|---|---|
| mol % | 0 | 0.05 | 0.1 | mol % | 0 | 0.05 | 0.1 | mol % | 0 | 0.05 | 0.1 |
| 0 | P − 3<br>N − 15<br>(%) | P 0<br>N − 8<br>(%) | P + 2<br>N − 3<br>(%) | 0 | P − 2<br>N − 9<br>(%) | P 0<br>N − 2<br>(%) | P 0<br>N − 3<br>(%) | 0 | P 0<br>N − 2<br>(%) | P 0<br>N − 3<br>(%) | P − 2<br>N − 6<br>(%) |
| 0.05 | P 0<br>N − 7<br>(%) | P + 2<br>N − 2<br>(%) | P + 1<br>N − 3<br>(%) | 0.05 | P 0<br>N − 3<br>(%) | P 0<br>N − 2<br>(%) | P − 1<br>N − 6<br>(%) | 0.05 | P 0<br>N − 3<br>(%) | P − 1<br>N − 5<br>(%) | P − 3<br>N − 10<br>(%) |
| 0.1 | P + 1<br>N − 3<br>(%) | P 0<br>N − 4<br>(%) | P 0<br>N − 7<br>(%) | 0.1 | P + 1<br>N − 3<br>(%) | P − 2<br>N − 6<br>(%) | P − 3<br>N − 7<br>(%) | 0.1 | P − 1<br>N − 5<br>(%) | P − 3<br>N − 10<br>(%) | P − 3<br>N − 15<br>(%) |

A surge current of 1000 amperes is employed to obtain the data shown in Table 3. The maximum surge current is evaluated in terms of the varistor voltage change caused by the above-shown current. "P" shown in Table 3 means a rate of change in the positive direction, and "N" means a change in the negative direction. As shown in Table 3, the maximum surge current characteristics can be optimized when the total amount of added Pb, Ge, and Sn is less than about 0.15 mol %, and this is independent of the combinations of these.

In yet another variation of the invention, Table 4 shows a varistor composition of this embodiment (Embodiment 5) featuring a lower sintering temperature, together with Example-1 having the same composition as this embodiment but sintered at a high temperature, and Example-2 having a conventional composition sintered at a low temperature. The composition in Table 5 is the same as that in Table 4.

TABLE 4

| | Composition (mol %) | | |
|---|---|---|---|
| | Embodiment-5 | Example-1 | Example-2 |
| ZnO | 97.655 | 97.655 | 98.345 |
| $Bi_2O_3$ | 1.0 | 1.0 | 1.0 |
| $Co_2O_3$ | 0.5 | 0.5 | 0.5 |
| $MnO_2$ | 0.15 | 0.15 | 0.15 |
| $Sb_2O_3$ | 0.5 | 0.5 | — |
| $Al_2O_3$ | 0.005 | 0.005 | 0.005 |
| $P_2O_5$ | 0.05 | 0.05 | — |
| $B_2O_3$ | 0.05 | 0.05 | — |
| PbO | 0.03 | 0.03 | — |
| $GeO_2$ | 0.03 | 0.03 | — |
| $SnO_2$ | 0.03 | 0.03 | — |

The compositions of this embodiment and Example-1 shown in Table 4 are an optimum determined after various compositions are tested in accordance with the previously described embodiments. The varistors of this embodiment and Example 1 are prepared using the method of the preferred embodiment of FIG. 1, and are sintered at a low temperature of 900° C. and a high temperature of 1240° C., respectively. The characteristics of each of the varistors are shown in Table 5.

TABLE 5

| | Embodiment-5 | Example-1 | Example-2 |
|---|---|---|---|
| $V_{1mA}$ | 200 | 180 | 110 |
| $V_{1mA}/V_{10\mu A}$ | 1.07 | 1.08 | 1.56 |
| $V_{25A}/V_{1mA}$ | 1.36 | 1.36 | 1.79 |

TABLE 5-continued

| | Embodiment-5 | Example-1 | Example-2 |
|---|---|---|---|
| Max surge current (A) | 2000 | 2000 | 500 |
| Change of $V_{1mA}$ (%) in N − dir. | 5 | 5 | 35 |

As shown in Table 5, Embodiment-5 shows characteristics nearly comparable to those of Example-1, and far superior to those of Example-2.

Figure 7:
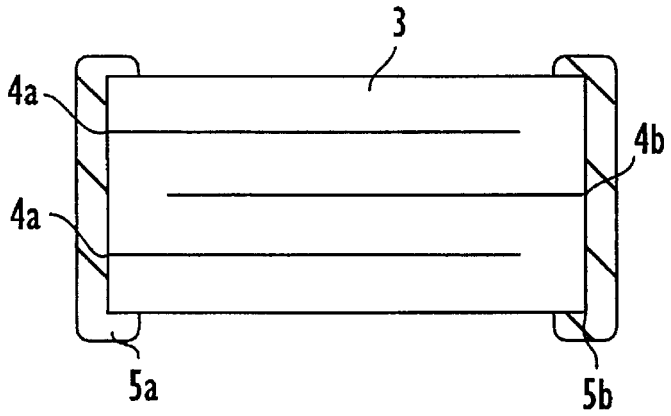
FIG. 7 shows a cross-sectional view of a laminated type varistor which is another embodiment of this invention.

In yet another variation of the invention depicted in FIG. 7, a laminated type varistor is prepared using materials including ZnO as a main constituent and accessory constituents of $Bi_2O_3$ added at an amount of about 1.0 mol %, $Co_2O_3$ at about 0.5 mol %, $MnO_2$ at about 0.15 mol %, $Sb_2O_3$ at about 0.5 mol %, GeO2 at about 0.05 mol%, $Al_2O_3$ at about 0.005 mol %, $B_2O_3$ at about 0.05 mol %, and $P_2O_3$ at about 0.05 mol %. The constituent elements are thoroughly mixed with a thoroughly mixed combination of a plasticizer and an organic solvent and this mixture is formed into green sheets having a thickness of 30 to 40 microns using a sharp blade or a doctor blade. A plurality of green sheets are then laminated into a ceramic sheet 3.

An electrode paste consisting of silver powder and an organic vehicle is then coated on one side of the ceramic sheet 3 in order to form internal electrodes **4*a* or 4*b*. Then, a plurality of ceramic sheets with internal electrode 4*a* or 4*b* are laminated so that internal electrodes 4*a* or 4*b* can be electrically connected at either edge of said ceramic sheets by applying said electrode paste on the edges to form external electrodes 5*a* and 5*b***.

After sintering this laminated varistor at 900° C., the varistor is dipped in a nickel-sulfate solution having a pH of about 4 to 5 kept at approximately 70° C. for 5 to 10 minutes in order to apply an electroless plating on external electrodes **5*a* and 5*b***, and then the varistor is dipped in a non-cyanide solution having a pH of about 6 to 7 for approximately 1 to 2 minutes in order to apply another electroless plating. Table 6 shows characteristics of the laminated type varistor of this embodiment and a conventional laminated varistor.

TABLE 6

| | Embodiment-6 | Conventional type |
|---|---|---|
| $V_{1mA}$ | 40 | 40 |
| $V_{1mA}/V_{10\mu A}$ | 1.09 | 1.10 |

TABLE 6-continued

| | Embodiment-6 | Conventional type |
|---|---|---|
| $V_{5A}/V_{1mA}$ | 1.33 | 1.35 |
| Max surge current (A) | 500 | 500 |
| Change of $V_{1mA}$ (%) in N – dir. | 5 | 5 |

The internal electrodes 4*a* and 4*b* of the conventional laminated type varistor shown in Table 6 are fabricated using an electrode paste consisting of platinum powder and an organic vehicle. The ceramic layers of the conventional varistor have the same composition as the varistor of this embodiment and are alternatively laminated and sintered at 1200° C. After fabricating external electrodes 5*a* and 5*b* using the same electrode paste, this laminate is sintered again at a temperature of 800° C.

As shown in Table 6, the varistor of this embodiment shows a characteristics that is by no-means inferior to that of conventional type despite the lower sintering temperature of this embodiment.

To better understand the invention, ceramic sheets of conventional Example 2 and Embodiment-5 of Table 4 are prepared, and laminated type varistors made of these ceramic sheets are prepared employing the method of Embodiment-6. The characteristics of these two types of varistors are shown in Table 7.

TABLE 7

| | Embodiment-6 | Conventional type |
|---|---|---|
| $V_{1mA}$ | 40 | 25 |
| $V_{1mA}/V_{10\mu A}$ | 1.08 | 1.45 |
| $V_{5A}/V_{1mA}$ | 1.32 | 1.75 |
| Max surge current (A) | 500 | 100 |
| Change of $V_{1mA}$ (%) in N – dir. | 5 | 35 |

As is apparent from Table 7, the varistor characteristics of Embodiment-6 are far superior to those of the conventional type of varistor.

In yet another variation of the invention, a varistor is prepared from materials including ZnO as a main constituent and accessory constituents of $Bi_2O_3$ added at an amount of about 0.50 mol %, $Co_2O_3$ at about 0.5 mol %, $MnO_2$ at about 0.15 mol %, $Sb_2O_3$ at about 0.25 mol %, NiO at about 0.25 mol%, $GeO_2$ at about 0.05 mol %, $Al_2O_3$ at about 0.005 mol %, and $B_2O_3$ at about 0.05 mol % which are thoroughly mixed, and sintered at a temperature of 930° C.

On the other hand, a conventional type varistor is prepared using ceramic materials including ZnO as a main constituent and accessory constituents of $Bi_2O_3$ added at an amount of 0.50 mol %, $Co_2O_3$ at 0.5 mol %, $MnO_2$ at 0.15 mol %, NiO at 0.25 mol %, $GeO_2$ at 0.05 mol %, $Al_2O_3$ at 0.005 mol %, and $B_2O_3$ at 0.05 mol %. The constituents are thoroughly mixed, and the varistor is formed using conventional sintering process.

A comparison of the characteristics of the varistor of this embodiment and the conventional varistor are shown in Table 8.

TABLE 8

| | Embodiment-7 | Conventional Example-1 |
|---|---|---|
| Density (g/cm$^3$) | 5.36 | 5.40 |
| $V_{1mA}$ (V) | 335 | 170 |
| $V_{1mA}/V_{10\mu A}$ | 1.15 | 1.23 |
| $V_{25A}/V_{1mA}$ | 1.36 | 1.52 |
| Change of surge $V_{1mA}$ · P – dir. (2000A) | –3.9 | –52.3 |
| Temp. coef. (125° C.) Change of $V_{1mA}$ | 0.4 | –15.3 |

As seen from Table 8, the varistor of this embodiment is superior to the conventional varistor with respect to the limiting voltage, maximum surge current, and temperature characteristics.

Although $Sb_2O_3/Bi_2O_3$ is set at about 0.5 mol % in this embodiment, the varistor characteristics are optimum at this condition. Since the varistor element and the electrodes can be sintered simultaneously, and the shrinkage coefficients of varistor element and the electrode at sintering are the same, and not only is the adhesion between the electrodes and the varistor element improved, but also the other varistor characteristics can be improved. Moreover, considering the same composition of the varistor element 1, the varistor voltage can be higher for the lower sintering temperature.

Although the density of varistor element could be higher when it is sintered at a lower temperature and for a long period, it tends to sacrifice the other characteristics.

Other variations can be made without parting from the spirit of the invention. For example, although Ag is used as the electrode material in this invention, Ag—Pd can be used as well.

Of course, it should be understood that a wide range of changes and modifications can be made to the preferred embodiments described above. It is therefore intended that the foregoing detailed description be regarded as illustrative rather than limiting and that it be understood that it is the following claims, including all equivalents, which are intended to define the scope of this invention.

What is claimed:

1. A varistor comprised of a sintered varistor element and a pair of electrodes provided on both sides of said varistor element containing zinc-oxide as a main constituent and at least bismuth and antimony as accessory constituents;

wherein the content of bismuth in the form of $Bi_2O_3$ is in a range from about 0.1 to 4.0 mol % and the content of antimony in the form of $Sb2O_3$ constitutes a mol-ratio of $Sb_2O_3/Bi_2O_3$ less than or equal to about 0.1 mol %, providing that the total amount of said main and said accessory constituents is 100 mol %.

2. The varistor of claim 1, further comprising boron in the form of $B_2O_3$ as an additional accessory constituent wherein an amount of $B_2O_3$ is less than or equal to about 0.5 mol %.

3. The varistor of claim 1, further comprising one or more of lead, germanium, or tin as additional accessory constituents for a total amount of ($PbO+GeO_2+SnO_2$) less than or equal to about 0.5 mol %.

4. The varistor of claim 1, further comprising one or more of lead, germanium, or tin as additional accessory constituents for a total amount of ($PbO+GeO_2+SnO_2$) less than or equal to about 0.15 mol %.

5. The varistor of claim 1, further comprising aluminum in the form of $Al_2O_3$ as an additional accessory constituent wherein an amount of $Al_2O_3$ is about 0.001 to about 0.01 mol %.

6. A varistor comprised of a sintered varistor element and a pair of electrodes provided on both sides of said varistor element containing zinc-oxide as a main constituent, and bismuth as an accessory constituent and one or more of antimony or phosphor as additional accessory constituents;

wherein the content of bismuth in the form of $Bi_2O_3$ is in a range from about 0.1 to about 4.0 mol % and the content of antimony or phosphor in the form of $Sb_2O_3$ or $P_2O_3$ satisfies a condition of $(Sb_2O_3+P_2O_5)$ less than or equal to about 1.0 mol %, providing that the content of $P_2O_5$ is less than about 0.3 mol % and the mol-ratio of $(Sb_2O_3+P_2O_5)/Bi_2O_3$ is less than about 1.0 mol %.

7. A varistor manufacturing method comprising the steps of:

adding bismuth used as an accessory constituent in the form of $Bi_2O_3$ in an amount of about 0.1 to 4.0 mol %; to at least one of antimony and phosphor used as other accessory constituents in the form of $Sb_2O_3$ and $P_2O_5$ in an amount of $(Sb_2O_3+P_2O_5)$ less than or equal to about 1.0 mol % and zinc-oxide used as a main constituent providing the content of $P_2O_5$ is limited within about 0.3 mol % satisfying a condition of mol-ratio of $(Sb_2O_3+P_2O_5)/Bi_2O_3$ less than or equal to about 1.0 to form a uniform mixture of these constituents;

forming a compact of said mixture;

applying an electrode-paste on both sides of said compact formed by a method such as press-molding; and sintering said compact and said electrode paste applied on said compact at a temperature of about 800° C. to 960° C. simultaneously.

8. A varistor manufacturing method comprising the steps of:

adding bismuth used as an accessory constituent in an amount of about 0.1 to about 4.0 mol % in the form of $Bi_2O_3$;

adding at least one of antimony and phosphor which is another accessory constituent satisfying a condition of $(Sb_2O_3+P_2O_5)$ less than or equal to about 1.0 mol % in terms of $Sb_2O_3$ and $P_2O_5$ yet satisfying a mol-ratio of $(Sb_2O_3+P_2O_5)/Bi_2O_3$ less than or equal to about 1.0 mol % to zinc-oxide used as a main constituent providing the amount of added $P_2O_5$ is limited within about 0.3 mol %;

forming a uniform mixture of said constituents;

forming this mixture into a ceramic sheet;

forming a laminate of said ceramic sheets comprising a plurality of said ceramic sheets and paired internal electrodes deposited on each of said ceramic sheets alternatively in a form exposing the edges of said internal electrodes alternatively at side edges of said ceramic sheets;

depositing a pair of external electrodes on both edge surfaces of said laminate; and sintering said laminate and said internal and external electrodes at a temperature of about 800° C. to about 960° C. simultaneously.

9. A varistor manufacturing method comprising the steps of:

adding antimony and bismuth used as accessory constituents to zinc-oxide used as a main constituent, wherein the content of said antimony is in the form of $Sb_2O_3$ and satisfies a condition of $(Sb_2O_3/Bi_2O_3)$ less than or equal to about 1.0 mol % and the content of said bismuth is in the form of $Bi_2O_3$ in a range from about 0.1 to about 4.0 mol %;

mixing said constituents uniformly into a mixture;

forming said mixture into a compact by a method such as press-molding;

applying an electrode-paste on sides of said compact; and sintering said compact and said electrode paste applied thereon at a temperature of about 800° C. to about 960° C. simultaneously.

10. The varistor manufacturing method of claim 9, wherein Ag paste or Ag—Pd paste is used as said electrode paste.

11. A varistor manufacturing method comprising the steps of:

adding antimony and bismuth used as accessory constituents to zinc-oxide used as a main constituent;

adding an amount of boron as an additional accessory constituent in the form of $B_2O_3$ that satisfies a condition of $B_2O_3$ less than or equal to about 0.5 mol %;

mixing said constituents uniformly into a mixture;

forming said uniform mixture into a compact by a method such as press-molding;

applying an electrode-paste on both sides of said compact; and sintering said compact and said electrode paste applied thereon at a temperature of about 800° C. to about 960° C. simultaneously.

12. A varistor manufacturing method comprising the steps of:

adding antimony and bismuth used as accessory constituents to zinc-oxide used as a main constituent;

adding an amount of at least one of lead, germanium, or tin as additional accessory constituents in the form of PbO, $GeO_2$, or $SnO_2$ that satisfies a condition of $(PbO+GeO_2+SnO_2)$ less than or equal to about 0.5 mol %;

mixing said constituents uniformly into a mixture;

forming said uniform mixture into a compact by a method such as press-molding;

applying an electrode-paste on both sides of said compact; and sintering said compact and said electrode paste applied thereon at a temperature of about 800° C. to about 960° C. simultaneously.

13. A varistor manufacturing method comprising the steps of:

adding bismuth and antimony used as accessory constituents to zinc-oxide used as a main constituent to form a uniform mixture, wherein the amount of added bismuth is about 0.1 to 4.0 mol % in the form of $Bi_2O_3$ and the amount of added antimony is in the form of $Sb_2O_3$ and satisfies a mol-ratio of $(Sb_2O_3)/Bi_2O_3$ less than or equal to about 1.0 mol %;

forming said uniform mixture into a ceramic sheet;

forming a laminate comprising a plurality of said ceramic sheets and a pair of internal electrodes disposed on said ceramic sheet alternatively exposing the edges of said internal electrodes alternatively at a side edge of said ceramic sheets;

depositing a pair of external electrodes on both edge-surfaces of said laminate; and sintering said laminate and said internal and external electrodes at a temperature of about 800° C. to about 960° C. simultaneously.

14. The varistor manufacturing method of claim 13 employing a Ag paste or Ag—Pd paste to dispose said pair of external electrodes.

15. The varistor manufacturing method of claim 13 employing an Ag paste or Ag—Pd paste to dispose said pair of internal electrodes.

16. A varistor manufacturing method comprising the steps of:

adding bismuth and antimony used as accessory constituents to zinc-oxide used as a main constituent to form a uniform mixture;

adding an amount of boron in the form of $B_2O_3$ that satisfies a condition of $B_2O_3$ less than or equal to about 0.5 mol %;

forming said uniform mixture into a ceramic sheet;

forming a laminate comprising a plurality of said ceramic sheets and a pair of internal electrodes disposed on said ceramic sheet alternatively exposing the edges of said internal electrodes alternatively at a side edge of said ceramic sheets;

depositing a pair of external electrodes on both edge-surfaces of said laminate; and sintering said laminate and said internal and external electrodes at a temperature of about 800° C. to about 960° C. simultaneously.

17. A varistor manufacturing method comprising the steps of:

adding bismuth and antimony used as accessory constituents to zinc-oxide used as a main constituent to form a uniform mixture;

adding an amount of at least one or more of lead, germanium, or tin as additional accessory constituents in the form of PbO, $GeO_2$, or $SnO_2$ that satisfies a condition of ($PbO+GeO_2+SnO_2$) less than or equal to about 0.5 mol % in terms of PbO, $GaO_2$, and $SnO_2$;

forming said uniform mixture into a ceramic sheet;

forming a laminate comprising a plurality of said ceramic sheets and a pair of internal electrodes disposed on said ceramic sheet alternatively exposing the edges of said internal electrodes alternatively at a side edge of said ceramic sheets;

depositing a pair of external electrodes on both edge-surfaces of said laminate; and sintering said laminate and said internal and external electrodes at a temperature of about 800° C. to about 960° C. simultaneously.

* * * * *